US010544588B2

(12) United States Patent
Cornelus et al.

(10) Patent No.: US 10,544,588 B2
(45) Date of Patent: Jan. 28, 2020

(54) MASONRY REINFORCEMENT STRUCTURE COMPRISING PARALLEL ASSEMBLIES OF GROUPED METAL FILAMENTS AND A POLYMER COATING

(71) Applicant: NV Bekaert SA, Zwevegem (BE)

(72) Inventors: Henk Cornelus, Avelgem (BE); David Six, Waasmunster (BE); Frederik Vervaecke, Ghent (BE); Nadine Van De Velde, Harelbeke (BE)

(73) Assignee: NV BEKAERT SA, Zwevegem (BE)

( * ) Notice: Subject to any disclaimer, the term of this patent is extended or adjusted under 35 U.S.C. 154(b) by 96 days.

(21) Appl. No.: 15/514,063

(22) PCT Filed: Aug. 25, 2015

(86) PCT No.: PCT/EP2015/069389
§ 371 (c)(1),
(2) Date: Mar. 24, 2017

(87) PCT Pub. No.: WO2016/050421
PCT Pub. Date: Apr. 7, 2016

(65) Prior Publication Data

US 2017/0241138 A1 Aug. 24, 2017

(30) Foreign Application Priority Data

Oct. 3, 2014 (EP) ..... 14187600

(51) Int. Cl.
*E04C 5/01* (2006.01)
*E04G 23/02* (2006.01)
(Continued)

(52) U.S. Cl.
CPC ..... *E04C 5/012* (2013.01); *B21F 27/005* (2013.01); *B21F 27/02* (2013.01); *D02G 3/12* (2013.01);
(Continued)

(58) Field of Classification Search
CPC . E04C 5/012; E04C 5/02; E04C 5/017; B21F 27/02; B21F 27/005; D04B 21/14;
(Continued)

(56) References Cited

U.S. PATENT DOCUMENTS 874,881 A * 12/1907 Baker ..... E04B 1/2608 52/712
903,000 A * 11/1908 Priest, Jr. ..... E04B 1/4185 52/562
(Continued)

FOREIGN PATENT DOCUMENTS

| | | |
|---|---|---|
| EP | 1 726 742 | 11/2006 |
| WO | 2009/062764 | 5/2009 |
| WO | 2014/161932 | 10/2014 |

OTHER PUBLICATIONS

International Search Report dated Oct. 26, 2015 in International (PCT) Application No. PCT/EP2015/069389.

*Primary Examiner* — Brent W Herring
(74) *Attorney, Agent, or Firm* — Wenderoth, Lind & Ponack, L.L.P.

(57) ABSTRACT

The invention relates to a masonry reinforcement structure (100) comprising at least two assemblies (102) of grouped metal filaments, at least one positioning element (104) for positioning the assemblies (102) of grouped metal filaments in a predetermined position and a polymer coating (110) for securing the assemblies (102) of grouped metal filaments in this predetermined position. The invention also relates to a method of manufacturing such masonry reinforcement structure (100) and to a roll comprising such a masonry reinforcement structure (100). The invention further relates to masonry reinforced with such masonry reinforcement structure (100) and to a method to apply such masonry reinforcement structure (100).

14 Claims, 4 Drawing Sheets

(51) Int. Cl.

| | |
|---|---|
| ***D03D 1/00*** | (2006.01) |
| ***D04B 21/14*** | (2006.01) |
| ***D03D 15/00*** | (2006.01) |
| ***D02G 3/12*** | (2006.01) |
| ***E04G 21/18*** | (2006.01) |
| ***D03D 9/00*** | (2006.01) |
| ***E04B 2/02*** | (2006.01) |
| ***D03D 15/02*** | (2006.01) |
| ***B21F 27/00*** | (2006.01) |
| ***B21F 27/02*** | (2006.01) |
| ***E04C 5/02*** | (2006.01) |

(52) U.S. Cl.
CPC ..... *D03D 1/00* (2013.01); *D03D 9/00* (2013.01); *D03D 15/00* (2013.01); *D03D 15/02* (2013.01); *D04B 21/14* (2013.01); *E04B 2/02* (2013.01); *E04C 5/017* (2013.01); *E04C 5/02* (2013.01); *E04G 21/1841* (2013.01); *E04G 23/0218* (2013.01); *D10B 2101/20* (2013.01); *D10B 2403/02411* (2013.01); *D10B 2505/20* (2013.01); *E04B 2002/0282* (2013.01)

(58) Field of Classification Search
CPC ..... D04B 2403/02411; D04B 2505/02; E04G 23/0218; E04G 21/1841; E04B 2/02; E04B 2002/0282; D10B 2403/02411; D10B 2505/20; B29C 70/885
USPC ..... 52/677, 442, 379, 712, 562, 565
See application file for complete search history.

(56) References Cited

U.S. PATENT DOCUMENTS 3,059,380 A * 10/1962 Holsman ..... E04B 2/10 52/442
3,340,660 A * 9/1967 Arcari ..... B28B 19/0053 249/119
4,433,493 A * 2/1984 Poisson ..... D04B 21/10 34/116
4,472,086 A * 9/1984 Leach ..... C09K 17/00 404/70
4,636,428 A * 1/1987 Bruner ..... D04B 21/12 442/306
4,689,931 A * 9/1987 Hodges ..... E04B 1/4178 52/442
4,756,136 A * 7/1988 Hodges ..... E04B 1/4178 52/687
5,110,656 A * 5/1992 Inaba ..... B29C 70/22 428/408
5,193,320 A * 3/1993 Coccagna ..... E04B 2/10 52/442
5,552,207 A * 9/1996 Porter ..... D03D 9/00 428/109
5,624,211 A * 4/1997 Anderson ..... E02D 29/02 405/262
5,763,043 A * 6/1998 Porter ..... D03D 9/00 428/109
6,629,393 B2 * 10/2003 Pignataro ..... E04B 2/02 52/432
6,706,376 B1 * 3/2004 Von Fransecky ..... D04B 21/10 428/212
7,523,626 B2 * 4/2009 Enzien ..... B29D 29/06 66/195
8,051,619 B2 * 11/2011 Hohmann, Jr. ..... E04G 21/1883 52/677
8,590,246 B2 * 11/2013 Coccagna ..... E04C 5/168 52/379
9,174,395 B2 * 11/2015 Durie ..... B29C 70/885
9,273,461 B1 * 3/2016 Hohmann, Jr. ..... E04B 1/4185
9,885,176 B2 * 2/2018 Cornelus ..... D04B 21/14
2003/0029123 A1 * 2/2003 Pignataro ..... E04B 2/02 52/712
2004/0182029 A1 * 9/2004 Berg ..... E04C 5/02 52/379
2006/0073752 A1 * 4/2006 Enzien ..... B29D 29/06 442/76
2006/0213234 A1 * 9/2006 Gladfelter ..... D03D 1/0047 66/190
2010/0266831 A1 * 10/2010 Durie ..... B29C 70/885 428/221
2011/0258964 A1 * 10/2011 Wu ..... E04B 1/14 52/791.1
2013/0247497 A1 * 9/2013 Toopchinezhad ..... B28B 7/183 52/565
2016/0010348 A1 * 1/2016 Cornelus ..... D04B 21/14 52/741.3
2016/0102453 A1 * 4/2016 Toopchinezhad ..... B28B 7/183 52/565
2018/0230050 A1 * 8/2018 Houel ..... D03D 15/0088

* cited by examiner

MASONRY REINFORCEMENT STRUCTURE COMPRISING PARALLEL ASSEMBLIES OF GROUPED METAL FILAMENTS AND A POLYMER COATING

TECHNICAL FIELD

The invention relates to a masonry reinforcement structure comprising assemblies of grouped metal filaments coated with a polymer coating. The invention also relates to a roll comprising such a masonry reinforcement structure. The invention further relates to masonry reinforced with such masonry reinforcement structure and to a method to apply such masonry reinforcement structure.

BACKGROUND ART

Masonry has a high compressive strength but a limited tensile strength. This leads to limitations in the design of masonry (such as limited height, limited width, limited length of masonry) and may lead to cracking when tensile and/or shear stresses develop in the masonry.

Bed joint reinforcement, for example prefabricated bed joint reinforcement of steel meshwork, is a proven technology for allowing masonry to carry higher loads (e.g. wind loads) by providing additional strength and flexibility, and for controlling cracks in masonry that is subject to tensile forces.

Bed joint reinforcement of steel meshwork for structural use (according to definitions of EN 845:3) generally comprises welded wire meshwork, such as two parallel longitudinal wires connected by a continuous zig-zag wire (truss type) or connected by straight cross wires (ladder type).

Prefabricated bed joint reinforcement structures typically have a length of about 3 m, for example 2.70 m or 3.05 m. This relatively long length makes the transportation, storing and handling of the structures complex.

To secure continuous reinforcement and to avoid weak points in reinforced masonry, overlapping of neighbouring prefabricated bed joint reinforcement elements is necessary and common practice. Overlapping leads to higher material consumption as double amount of material is required in the overlap zones.

Furthermore, as overlaps between neighbouring bed joint reinforcement structures may not be located at areas of high stress or at areas where the dimensions of a section change (for example a step in a wall height or thickness), the work of the installer of bed joint reinforcement elements is complicated.

DISCLOSURE OF INVENTION

It is an object of the present invention to provide an improved masonry reinforcement structure avoiding the drawbacks of the prior art.

It is another object of the present invention to provide a masonry reinforcement structure that can easily be rolled up and rolled out.

It is a further object of the present invention to provide a masonry reinforcement structure that when rolled out lies and remains in a flat position making additional precautions or steps to obtain a flat position of the masonry reinforcement structure superfluous.

It is a further object of the present invention to provide a masonry reinforcement structure comprising assemblies of metal filaments for example steel cords that are secured in a predetermined position.

It is a further object of the present invention to provide a masonry reinforcement structure that can be provided in rolls of long length.

It is a further object of the present invention to provide a masonry reinforcement structure that makes the use and handling of the masonry reinforcement structure easy, for example the use and handling on a construction site.

It is a further object of the present invention to provide a masonry reinforcement structure that allows to minimize the number of overlaps between neighbouring structures.

It is still a further object of the present invention to provide a masonry reinforcement structure having a minimal thickness allowing easy positioning in the joints, for example glue joints or mortar joints.

It is a further object to provide a masonry reinforcement structure having an improved corrosion resistance.

It is still a further object of the present invention to provide a masonry reinforcement structure that can be recycled easily.

According to a first aspect of the present invention a masonry reinforcement structure comprising at least two assemblies of grouped metal filaments is provided. The reinforcement structure further comprises at least one positioning element for positioning said at least two assemblies of grouped metal filaments in a predetermined position.

A polymer coating is applied on said at least two assemblies of grouped metal filaments and on said at least one positioning element. The polymer coating secures that said at least two assemblies of grouped metal filaments remain in their predetermined position and this for example during the manufacturing, storing, transporting, installation and use of the structure for reinforcement of masonry.

The application of the polymer coating may have other advantages. The application of the polymer coating may for example have a positive effect on the corrosion resistance of the metal filaments.

Furthermore the strength of the assemblies of grouped metal elements and/or of the positioning element may be increased by the application of the polymer coating.

As the polymer coating holds the assemblies of grouped metal elements and the positioning element or positioning elements together for example during the demolishing of the reinforced masonry, the polymer coating may simplify the recycling process.

The masonry reinforcement structure according to the present invention comprises preferably a bed joint reinforcement structure.

A bed joint reinforcement structure is defined as a reinforcement structure that is prefabricated for building into a bed joint.

The masonry reinforcement structure has a length L and a width W, with L being larger than W.

In preferred embodiments of reinforcement structures according to the present invention the assemblies of grouped metal filaments are oriented parallel or substantially parallel. Preferably, the assemblies of grouped metal filaments are oriented parallel or substantially parallel in the length direction of the masonry reinforcement structure. The assemblies of grouped metal filaments of a masonry reinforcement structure according to the present invention are preferably parallel or substantially parallel over the full length of the masonry reinforcement structure.

Preferably, the assemblies are not intertwisted or interconnected. The assemblies of grouped metal filaments are positioned in said parallel or substantially parallel position by at least one positioning element and are held in said parallel or substantially parallel position by means of said polymer coating.

With "parallel" or "substantially parallel" is meant that the main axes of the assemblies of grouped metal filaments are parallel or substantially parallel to each other.

With "substantially parallel" is meant that there may be some deviation from the parallel position. However, if there is a deviation, the deviation from the parallel position is either small or accidental. With small deviation is meant a deviation less than 5 degrees and preferably less than 3 degrees or even less than 1.5 degrees.

Assembly of Grouped Metal Filaments

For the purpose of this invention with "an assembly of grouped metal filaments" is meant any unit or group of a number of metal filaments that are assembled or grouped in some way to form said unit or said group. The metal filaments of an assembly of grouped metal filaments can be assembled or grouped by any technique known in the art, for example by twisting, cabling, bunching, gluing, welding or wrapping.

Examples of assemblies of grouped metal filaments comprise bundles of parallel or substantially parallel metal filaments, filaments that are twisted together for example by cabling or bunching such as strands, cords or ropes.

A first group of preferred assemblies of grouped metal filaments comprises cords, for example single strand cords or multistrand cords. Masonry reinforcement structures comprising cords as assemblies of grouped metal filaments have the advantage that they can easily be rolled up and rolled out. Furthermore masonry reinforcement structures comprising cords lie in a flat position when rolled out and remain in this flat position without requiring additional precautions or steps to obtain or maintain this flat position.

A second group of preferred assemblies of grouped metal filaments comprises bundles of parallel metal filaments. Masonry reinforcement structures comprising assemblies of the second group have the advantage that they can easily be rolled up and rolled out and that such masonry reinforcement structures lie in a flat position when rolled out and remain in this flat position without requiring additional precautions or steps to obtain or maintain this flat position.

Next to being flexible and allowing that the reinforcement structure lies and remains in a flat position when rolled out, assemblies comprising metal filaments in a parallel position may have the advantage of having a limited thickness as all filaments can be positioned next to each other.

The number of filaments in an assembly ranges preferably between 2 and 100, for example between 2 and 81, between 2 and 20, for example 6, 7, 10 or 12.

Metal Filaments

As metal filaments any type of elongated metal filaments can be considered. Any metal can be used to provide the metal filaments. Preferably, the metal filaments comprise steel filaments. The steel may comprise for example high carbon steel alloys, low carbon steel alloys or stainless steel alloys.

The metal filaments preferably have a tensile strength higher than 1000 MPa, for example higher than 1500 MPa or higher than 2000 MPa.

The metal filaments have a diameter preferably ranging between 0.04 and 2 mm. More preferably, the diameter of the filaments ranges between 0.10 and 1 mm as for example between 0.2 and 0.5 mm, for example 0.25, 0.33, 0.37, 0.38 or 0.45 mm.

All metal filaments of an assembly of grouped metal filaments may have the same diameter. Alternatively, an assembly of grouped metal filaments may comprise filaments having different diameters.

An assembly of grouped metal filaments may comprise one type of metal filaments. All filaments of an assembly of metal filaments for example have the same diameter and the same composition. Alternatively, an assembly of grouped filaments may comprise different diameters and/or different compositions. An assembly of grouped filaments may for example comprise non-metal filaments next to metal filaments. Examples of non-metal filaments comprising carbon or carbon based filaments or yarns, polymer filaments or polymer yarns, such as filaments or yarns made of polyamide, polyethylene, polypropylene or polyester. Also glass yarns or rovings of glass fibers can be considered.

The metal filaments preferably have a circular or substantially circular cross-section although filaments with other cross-sections, such as flattened filaments or filaments having a square or a substantially square cross-section or having a rectangular or a substantially rectangular cross-section can be considered as well.

The metal filaments can be uncoated or can be coated with a suitable coating, for example a coating giving corrosion protection. Suitable coatings comprise a metal coating such as a zinc or zinc alloy coating or a polymer coating. Examples of metal or metal alloy coatings comprise zinc or zinc alloy coatings, for example zinc brass coatings, zinc aluminium coatings or zinc aluminium magnesium coatings. A further suitable zinc alloy coating is an alloy comprising 2 to 10% Al and 0.1 to 0.4% of a rare earth element such as La and/or Ce.

Examples of polymer coatings comprise polyethylene, polypropylene, polyester, polyurethane and blends thereof.

For a person skilled in the art it is clear that a coating such as a coating giving corrosion protection can be applied on the filaments. However, it is also possible that a coating is applied on an assembly of grouped metal filaments.

Number of Assemblies

A masonry reinforcement structure according to the present invention comprises at least two assemblies of grouped metal filaments. In principle there is no limitation to the number of assemblies of grouped metal filaments. Preferably, the number of assemblies of grouped metal filaments ranges between 2 and 500, for example between 4 and 300. The number of assemblies of grouped metal filaments is for example 10, 20, 50, 100, 200 or 300.

Preferably, the different assemblies of a masonry reinforcement structure according to the present invention are spaced apart. The distance between neighbouring assemblies may vary within a wide range, the distance between neighbouring assemblies is for example higher than 1 mm and lower than 80 cm. The distance between neighbouring assemblies is for example ranging between 1 mm and 10 cm, for example 5 mm, 1 cm, 2 cm, 3 cm, 5 cm, 7 cm or 8 cm.

For many applications a minimum distance between neighbouring assemblies is preferred as this results in a better embedment and a better anchorage of the assemblies in the mortar or glue and allows a better penetration of the mortar or glue.

The distance between neighbouring assemblies can be equal over the width of the structure of the masonry reinforcement structure.

Alternatively, it can be preferred that the distance between neighbouring assemblies is lower in some areas of the masonry reinforcement structure, for example in areas where stresses are high such as at the edges of the structure to be reinforced.

The distance between neighbouring assemblies can for example be lower at the outer sides of the masonry reinforcement structure compared to the distance between neighbouring assemblies in the middle portion of the masonry reinforcement structure.

A masonry reinforcement structure according to the present invention may comprise one type of assemblies of grouped metal filaments. All assemblies of grouped metal filaments have for example the same number of metal filaments, the same construction and comprise the same material. Alternatively, a masonry reinforcement structure comprises a number of different types of assemblies of grouped metal filaments, for example assemblies of grouped metal filaments having a different number of filaments, having a different cord construction or made of a different material.

Positioning Element

As positioning element any element suitable for positioning the at least two assemblies of grouped metal filaments in a predetermined position can be considered. The masonry reinforcement structure according to the present invention may comprise one positioning element or a number of positioning elements, for example 2, 3, 4 or more positioning elements. Examples of positioning elements comprise substrates or elongated elements or combinations thereof.

Substrates comprise for example films, foils, grids, woven structures, non woven structures or combinations thereof. The substrates comprise for example a polymer material, a metal or metal alloy or a composite material.

Examples of elongated elements comprise yarns, rovings, filaments such as metal wires, cords or any combination thereof. The yarns comprise for example a polymer material, a metal or metal alloy or a composite material.

In preferred embodiments the positioning element or elements comprise a yarn or a number of yarns. The yarn positions the assemblies of grouped metal filaments for example by forming stitches.

In alternative embodiments the yarn forms the warp or the weft of a woven structure. An example of such woven structures comprises assemblies of grouped metal filaments in the warp direction and yarn in the weft direction.

In further embodiments the yarn forms stitches to couple or connect the assemblies of grouped metal filaments to a substrate, for example to a non-woven structure or to a grid. In such embodiments, the yarn and the substrate are both considered as positioning element.

The yarn comprises preferably a textile yarn.

For the purpose of this invention with "yarn" is meant any fiber, filament, multifilament of long length in particular suitable for use in the production of textiles.

Yarns comprise for example spun yarns, zero-twist yarns, single filaments (monofilaments) with or without a twist, narrow strip of materials with or without twist, intended for use in a textile structures.

The at least one yarn may comprise a natural material, a synthetic material or a metal or a metal alloy. Also hybrid yarns can be considered. Natural material comprises for example cotton.

Preferred synthetic materials comprise polyamide, polyester, polyethylene, polypropylene, polyether sulphone and polyvinyl alcohol. Also yarns made of glass fibers can be considered.

Preferred metal or metal alloys comprise steel such as low carbon steel, high carbon steel or stainless steel.

Hybrid yarns comprise for example synthetic yarns reinforced with glass fibers or reinforced with steel fibers.

Preferably, the yarn used in the structure for the masonry reinforcement structure is suitable for use in a textile operation such as sewing, stitching, knitting, embroidery and weaving.

In order to be suitable in a textile operation and more particularly in a sewing, knitting or embroidery operation, the yarn is preferably bendable. Preferably, the at least one yarn can be bent to a radius of curvature smaller than 5 times the equivalent diameter of the yarn. More preferably the at least one yarn can be bent to a radius of curvature lower than 4 times the diameter of the yarn, lower than 2 times the diameter of the yarn or even lower than the diameter of the yarn.

Furthermore the yarn is preferably suitable to hold and secure the assemblies of grouped metal filaments in their mutual parallel or mutual substantially parallel position.

It is clear that the yarn used preferably allows to maintain the flexibility of the structure so that the structure can be rolled up and rolled out easily.

The masonry reinforcement structure according to the present invention may comprise one yarn or a number of yarns. The number of yarns is for example ranging between 1 and 100; for example ranging between 1 and 50, for example 10.

In other preferred embodiments the positioning element or elements comprise a roving or a number of rovings, for example glass rovings, polypropylene rovings or polyester rovings.

Possibly, the assemblies of grouped metal filaments are connected or coupled to these rovings for example by gluing, stitching, knitting or embroidering.

Polymer Coating

As polymer coating any type of polymer coating can be considered. Preferred coatings comprise water soluble, water-dispersable or water-emulsable formulations.

Preferred examples comprise acrylic or acrylic based coatings or blends thereof as for example polyurethane acrylic or styrene acrylic coatings.

Other preferred examples comprise polyethylene based coating or blends thereof and polyurethane based coating or blends thereof.

The polymer coating can be applied by any method known in the art. In a preferred method the coating is applied by dipping the structure comprising the assemblies of grouped metal filaments and the at least one positioning element in a polymer dispersion.

Possibly, the coating is dried or cured.

Other methods to apply the polymer coating on the structure comprise extrusion, hot melt, brushing, rolling or spraying.

For a masonry reinforcement structure according to the present invention both the assemblies of grouped metal filaments and the positioning element(s) are coated with a polymer coating.

The polymer coating has a thickness preferably ranging between 1 and 100 μm, more preferably ranging between 2 and 50 μm. The thickness of the polymer coating is for example 3 μm, 5 μm, 10 μm, 20 μm or 30 μm.

Within the context of the present invention, the function of the polymer coating is to secure the parallel relationship of the assemblies of metal filaments. The polymer coating is therefore applied to the structure with the assemblies in parallel relationship as a whole. Such a securing polymer coating is to be distinguished from polymer coatings on individual metal filaments or individual assemblies prior to making the structure. The individual polymer coatings do not secure the parallel relationship, except in case the structure with the parallel assemblies is heated to such an extent that the individual polymer coating starts to melt and creates a bonding with other contacting elements.

In other words, a securing polymer coating makes a bond between, on the one hand, the assemblies of metal filaments and, on the other hand, the positioning element.

A first group of preferred embodiments of masonry reinforcement structures comprise assemblies of grouped metal filaments, at least one yarn as positioning element and a polymer coating applied on the structure formed by the assemblies and the at least one yarn.

The at least one yarn forms stitches to position the assemblies of grouped metal elements in a predetermined position, for example in a mutual parallel or mutual substantially parallel position. The stitches are preferably formed around the assemblies of grouped metal filaments. The stitches are preferably formed by at least one operation selected from stitching, knitting or embroidering.

Examples of structures of this first group comprise textile structures comprising assemblies of grouped metal filaments and at least one yarn, such as a knitted structure or a braided structure.

A second group of preferred embodiments of masonry reinforcement structures comprise assemblies of grouped metal filaments, a substrate as positioning element and a polymer coating applied on the structure formed by the assemblies and the substrate.

Possibly, the assemblies are connected or coupled to the substrate, for example by gluing, stitching, knitting, embroidering, welding, melting or laminating.

As substrate any substrate allowing the coupling or connection of the assemblies of grouped metal filaments can be considered.

The substrate may either comprise a metal material, a non-metal material or a combination of both a metal material and a non-metal material.

Examples of substrates comprise woven structures, non-woven structures, films, strips, foils, meshes, grids or foams.

As non-woven substrates needlebonded, waterbonded, spunbonded, airlaid, wetlaid or extruded substrates can be considered.

Preferred foils or grids are foils or grids obtained by extrusion, for example foils or grids comprising polypropylene, polyethylene, polyamide, polyester or polyurethane.

Preferred metal substrates comprise metal grids or metal meshes, for example steel grids or steel meshes.

The substrate may comprise an open structure or alternatively a closed structure. A substrate having an open structure has the advantage that it is permeable for the glue or mortar when installed in the masonry. Furthermore open structures have a lower weight and higher flexibility.

Substrates comprising a non-metal material comprise for example glass, carbon or polymer material. Preferred polymer materials comprise polyester, polyamide, polypropylene, polyethylene, polyvinyl alcohol, polyurethane, polyethersulphone, ethylene vinyl acetate or any combination thereof. Also polymer coated foils or grids can be considered such as ethylene vinyl acetate coated foils or grids.

As metal substrates steel substrates, for example substrates made of steel wire such as meshes or grids can be considered.

It is clear that substrates comprising hybrid or composite materials can be considered as well.

For a person skilled in the art it is clear that a structure of the first group such as a knitted or braided structure can be coupled to a substrate. The term 'coupled to' should be understood in a broad meaning and includes all possible manners whereby the assemblies of grouped metal filaments are coupled to a substrate. For the purpose of this invention coupling includes connecting, joining, bonding, adhering, . . . .

A third group of preferred embodiments of masonry reinforcement structures comprise assemblies of grouped metal element, one or more connecting structures as positioning element and a polymer coating. A great variety of structures can be considered as connecting structure. The connecting structure comprises for example one or a number of zig-zag like elongated element(s) or a number of separate transversal elements.

In a preferred example the connecting structure comprises one or a number of zig-zag like roving(s) or yarn(s) connecting a number of parallel or substantially parallel assemblies of metal filaments.

In an alternative preferred example the masonry reinforcement structure has assemblies of grouped metal elements in the longitudinal direction of the masonry reinforcement structure and a connecting structure comprising a number of rovings or yarns in transversal direction of the masonry reinforcement structure.

Possibly, the assemblies are connected or coupled to the connecting structure, for example by gluing, stitching, knitting or embroidering.

A further group of preferred embodiments of masonry reinforcement structures comprise woven structures, for example woven structures having assemblies of grouped metal filaments in warp direction and at least one positioning element in weft direction. The positioning element in weft direction comprises for example a yarn or a number of yarns, a metal wire or a number of metal wires or a metal cord or a number of metal cords. A polymer coating is applied on the woven structures.

For a person skilled in the art it is clear that a woven structure according to the present invention may comprise other elements such as yarns in the warp direction next to the assemblies of grouped metal filaments. The woven structure according to the present invention may also comprise assemblies of grouped metal filament in the weft direction.

Thanks to the high flexibility of the assemblies of grouped metal filaments, the masonry reinforcement structure according to the present invention has a high flexibility. Because of the low thickness and the elasticity of the polymer coating, there is no or very little negative influence of the polymer coating on the flexibility of the reinforcement structure. A masonry reinforcement structure according to the present invention can thus easily be rolled up and rolled out.

Furthermore when rolled out the masonry reinforcement structure lies in a flat position and remains in a flat position without requiring additional precautions or steps to obtain a flat position.

This makes the use at a construction site easy. The masonry reinforcement structure can be rolled out on a masonry structure for example on a layer of bricks or blocks.

The masonry reinforcement structure can be easily cut to the required length.

As the masonry reinforcement structure can be provided at long lengths, the number of overlaps between neighbouring masonry reinforcement structures is substantially reduced compared to masonry reinforced with prefabricated bed joint reinforcement structures presently known in the art. Furthermore pull out tests have shown that the presence of the polymer coating has no negative influence on the pull out force.

A further advantage of a masonry reinforcement structure according to the present invention is the minimal thickness of the masonry reinforcement structure allowing easy positioning in the joints (for example glue joints or mortar joints).

The masonry reinforcement structure may have an open structure or alternatively a closed structure. A masonry reinforcement structure having an open structure has the advantage that it is permeable for the glue or mortar. Furthermore open structures have a lower weight and higher flexibility.

Preferably a masonry reinforcement structure has a positioning element that comprises a zigzag roving or yarn connected to the assemblies of metal filaments.

The term "zigzag" refers to every form of this roving or yarn going between the extreme left assembly of metal filaments and the extreme right assembly of metal filaments. This zigzag form can be sinusoidal, a succession of U-forms or a succession of V-forms or whatever other "go-between" form.

Most preferably, the positioning element further comprises a textile yarn that has been knitted or stitched around the assemblies of metal filaments and the zigzag roving or yarn.

Preferably part of said polymer coating has penetrated into the textile yarns, thereby further securing the parallel relationship between the assemblies of metal filaments.

The polymer will particularly adhere to the zigzag roving or yarn and the textile yarns. The polymer will also partially (i.e. will cover part) or totally (i.e. will cover 100% of surface) adhere to the assemblies of metal filaments thereby increasing the corrosion resistance.

The result is an open structure leaving space for mortar or glue to penetrate during application in a bed joint of a masonry.

According to a second aspect of the present invention a method to manufacture a masonry reinforcement structure is provided. The method comprises the steps of:

- providing at least two assemblies of grouped metal filaments;
- providing at least one positioning element for positioning said at least two assemblies of grouped metal filaments in a predetermined position;
- manufacturing a structure comprising said at least two assemblies of grouped metal filaments and said at least one positioning element;
- applying a polymer coating on said structure comprising said at least two assemblies of grouped metal filaments and said at least one positioning element.

Preferred methods to apply the polymer coating comprise dipping, spraying, extrusion, hot melt, brushing or rolling.

Preferred methods to manufacture the structure comprising the at least two assemblies and the at least one positioning element comprise welding, weaving, gluing, stitching, knitting, braiding, embroidering or any combination thereof.

According to a third aspect of the present invention a roll of a masonry reinforcement structure as described above is provided. The masonry reinforcement structure is wound or coiled to form said roll.

As the masonry reinforcement structure according to the present invention is flexible, the structure can easily be rolled up and rolled out.

According to a fourth aspect of the present invention a method to install a masonry reinforcement structure as described above is provided. The method to install the masonry reinforcement structure comprises the steps of

- providing masonry comprising at least one layer of units or bricks;
- uncoiling a masonry reinforcement structure as described above and if required cutting the masonry reinforcement structure to the desired length;
- installing said masonry reinforcement structure in a joint (for example in a mortar or glue joint) on the upper surface of the last layer of units or bricks;
- providing the next layer of units or bricks on said joint.

The masonry reinforcement structure can be installed in said joint by first applying a layer of mortar or glue on the upper surface of the last layer of units or bricks and by subsequently applying the masonry reinforcement structure.

Alternatively, the masonry reinforcement structure can be installed in said joint by first applying the masonry reinforcement structure on the upper surface of the last layer of units or bricks and by subsequently applying a layer of mortar or glue on the masonry reinforcement structure.

In a further method a first layer of mortar or glue is applied on the upper surface of the last layer of units or bricks, the masonry reinforcement structure is applied on the masonry reinforcement structure, followed by the application of a second layer of mortar or glue on the masonry reinforcement structure.

According to a fifth aspect of the present invention masonry reinforced with at least one masonry reinforcement structure according to the present invention is provided.

The masonry comprises a number of layers of units or bricks and joints between two neighbouring layers of units or bricks. At least one joint is reinforced by a masonry reinforcement structure according to the present invention.

The joints may comprise mortar joints or glue joints.

BRIEF DESCRIPTION OF FIGURES IN THE DRAWINGS

The invention will now be described into more detail with reference to the accompanying drawings whereby FIG. 1 is an illustration of a masonry reinforcement structure comprising a woven structure;

MODE(S) FOR CARRYING OUT THE INVENTION

Figure 1:
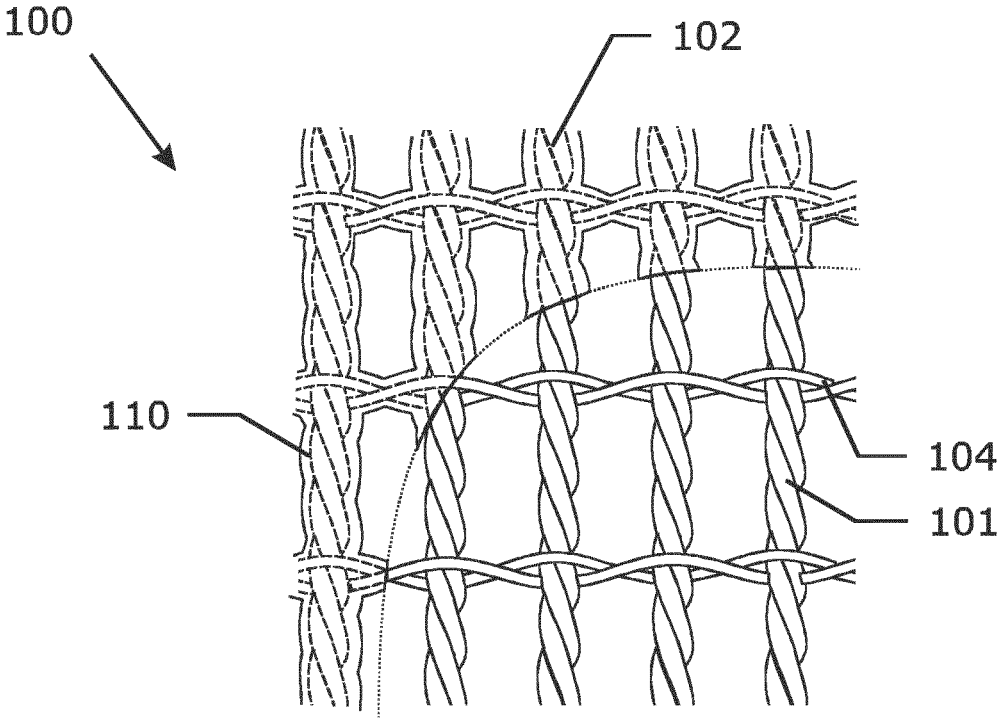

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

The following terms are provided solely to aid in the understanding of the inventions:

Masonry: all building systems that are constructed by stacking units of for example stone, clay, or concrete, joined by for example mortar or glue into the form of for example walls, columns, arches, beams or domes;

Equivalent diameter of a yarn or filament: the diameter of an imaginary yarn or filament having a circular radial cross-section, which cross-section has a surface identical to the surface area of the particular yarn or filament FIG. 1 is an illustration of a first embodiment of a masonry reinforcement structure 100 according to the present invention. The masonry reinforcement structure 100 comprises a woven structure 101. The woven structure 101 comprises assemblies of grouped metal filaments 102 in the warp direction. The assemblies of grouped metal filaments 102 comprise for example steel cords. Preferred steel cords comprise between 2 and 12 filaments, for example a cord having one core filament having a diameter of 0.37 mm and 6 filaments having a diameter of 0.33 m around this core filament (0.37+6×0.33).

In alternative embodiments the assemblies of grouped metal filaments 102 comprise bundles of parallel or substantially parallel filaments, for example bundles of 12 parallel or substantially parallel filaments.

The weft direction comprises for example a polymer yarn 104, such as a polyamide, a polyether sulphone, a polyvinyl alcohol or a polypropylene yarn.

A polymer coating 110 is applied on the woven structure 101. The polymer coating 110 comprises for example an acrylic coating. The thickness of the polymer coating 110 is for example 10 μm or 20 μm. The polymer coating 110 is applied by dipping the woven structure 101 in an acrylic dispersion.

In alternative embodiments the weft direction comprises a metal yarn, for example a steel yarn. The masonry reinforcement structure 100 is preferably an open structure permeable for the glue or mortar.

It is clear for a person skilled in the art that different weave patterns can be considered.

Figure 2:
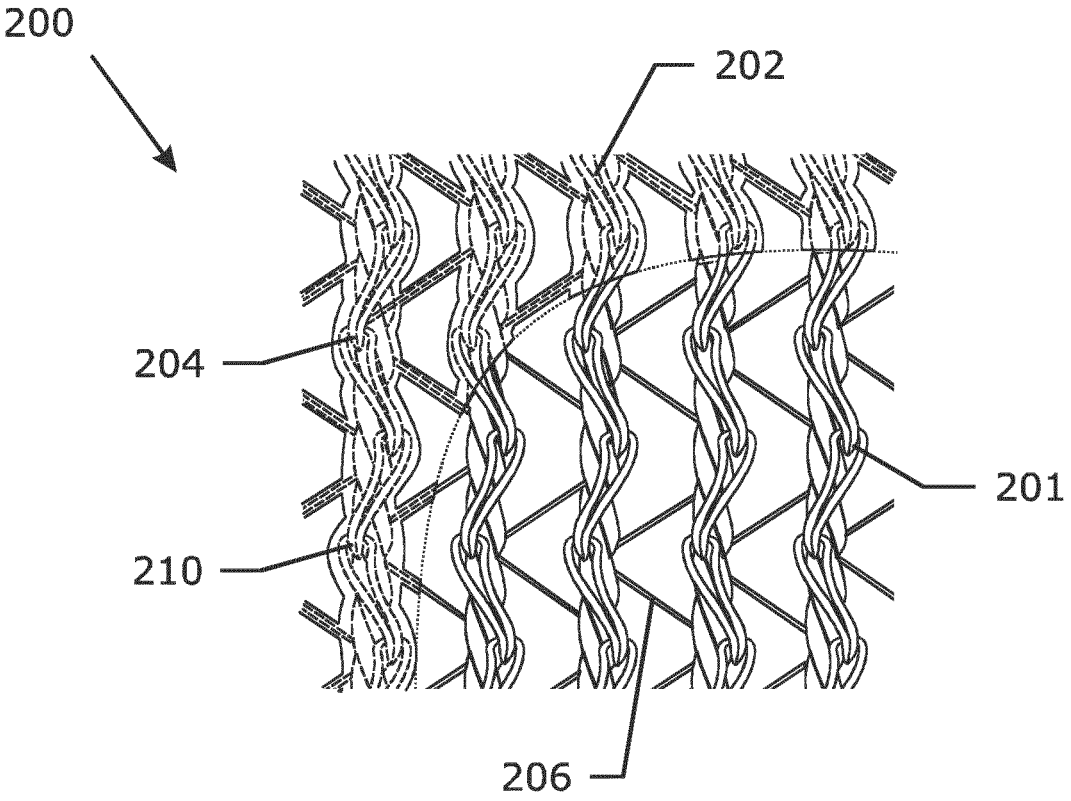
FIG. 2 is an illustration of a masonry reinforcement structure comprising a knitted structure.

FIG. 2 shows a second embodiment of a masonry reinforcement structure 200 according to the present invention. The masonry reinforcement structure 200 comprises a knitted structure 201. The knitted structure 201 comprises assemblies of grouped metal filaments 202 as pillar threads. The assemblies of grouped metal filaments 202 comprise for example steel cords comprising 3 filaments having a diameter of 0.48 mm twisted together (3×0.48 mm).

In alternative embodiments the assemblies of grouped metal filaments 202 comprise parallel or substantially parallel filaments, for example a bundle of 12 parallel or substantially parallel filaments.

The knitted structure 201 further comprises yarn 204 and yarn 206 to keep the assemblies of grouped metal filaments in their mutual parallel or mutual substantially parallel position. The yarn 204 is for example a multifilament yarn, preferably a polyamide, a polyether sulphone, a polyvinyl alcohol or a polypropylene yarn. The yarn 204 may also comprise a metal yarn, for example a steel yarn.

The yarn 206 is connecting neighbouring assemblies of grouped metal filaments 202. The monofilament yarn 206 is preferably a polyamide, a polyether sulphone, a polyvinyl alcohol or a polypropylene yarn. The yarn 206 may also comprise a metal yarn, for example a steel yarn. A polymer coating 210 is applied on the masonry reinforcement structure 200. The polymer coating comprises for example a styrene acrylic coating. The thickness of the polymer coating is for example 10 μm, 15 μm or 20 μm.

Figure 3:
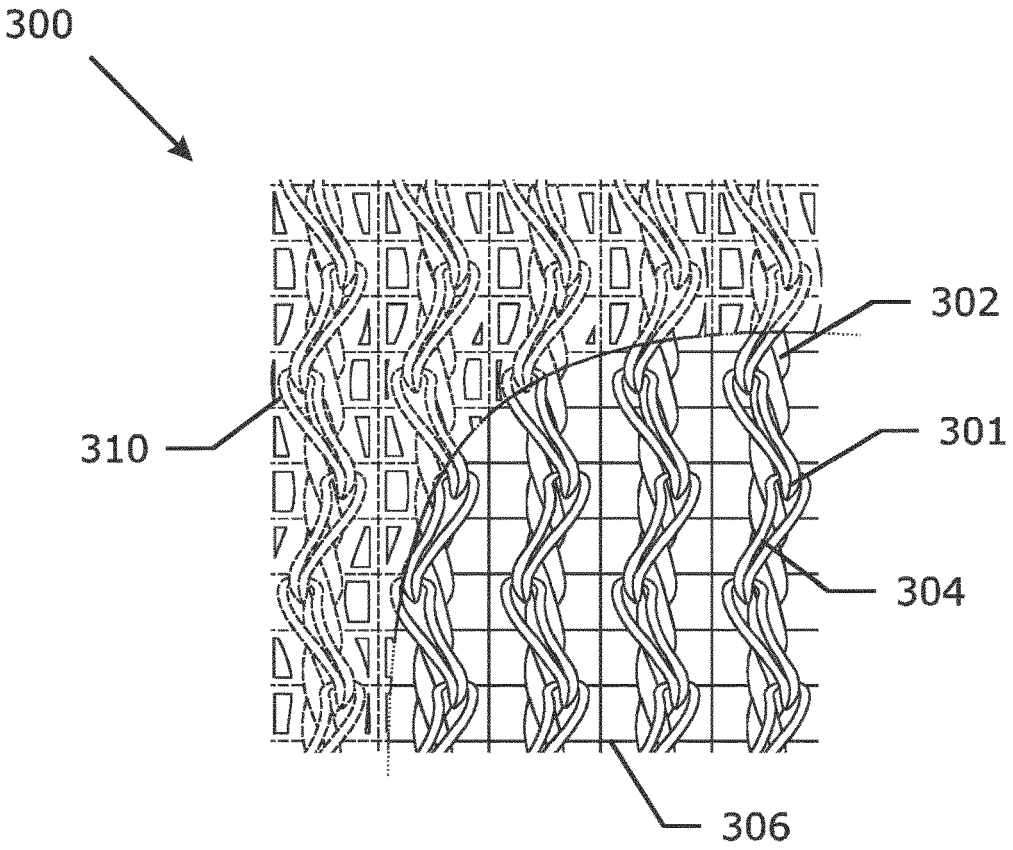
FIG. 3 is an illustration of a masonry reinforcement structure comprising parallel assemblies of grouped metal filaments stitched to a substrate.

FIG. 3 is an illustration of a masonry reinforcement structure 300 comprising a structure 301 of parallel assemblies of grouped metal filaments 302 stitched to a substrate 310. The assemblies 302 are stitched to the substrate 310 by means of yarn 304. The assemblies of grouped metal filaments 302 comprise steel cords or bundles of parallel filaments. The yarn 304 forms stitches to couple the steel cords to the substrate 306.

The substrate 306 comprises for example a woven or non-woven polymer structure.

A polymer coating 310 is applied on the masonry reinforcement structure 200. The polymer coating 310 comprises for example a styrene acrylic coating. The thickness of the polymer coating is for example 20 μm. In a preferred embodiment the cords comprise steel cords that are stitched to a polymer substrate for example to a non-woven polyether sulphone substrate by means of a polyether sulphone yarn or to an extruded polypropylene grid (35 g/m$^2$ having a 6×6 mm mesh) by means of a polypropylene yarn.

In another preferred embodiment the cords are steel cords stitched to a metal substrate, for example a steel mesh or steel grid by a metal yarn, for example a steel yarn. Such structure fully consisting of one material, more particularly metal (steel) is easier to recycle compared to structures comprising a number of different materials.

Figure 4:
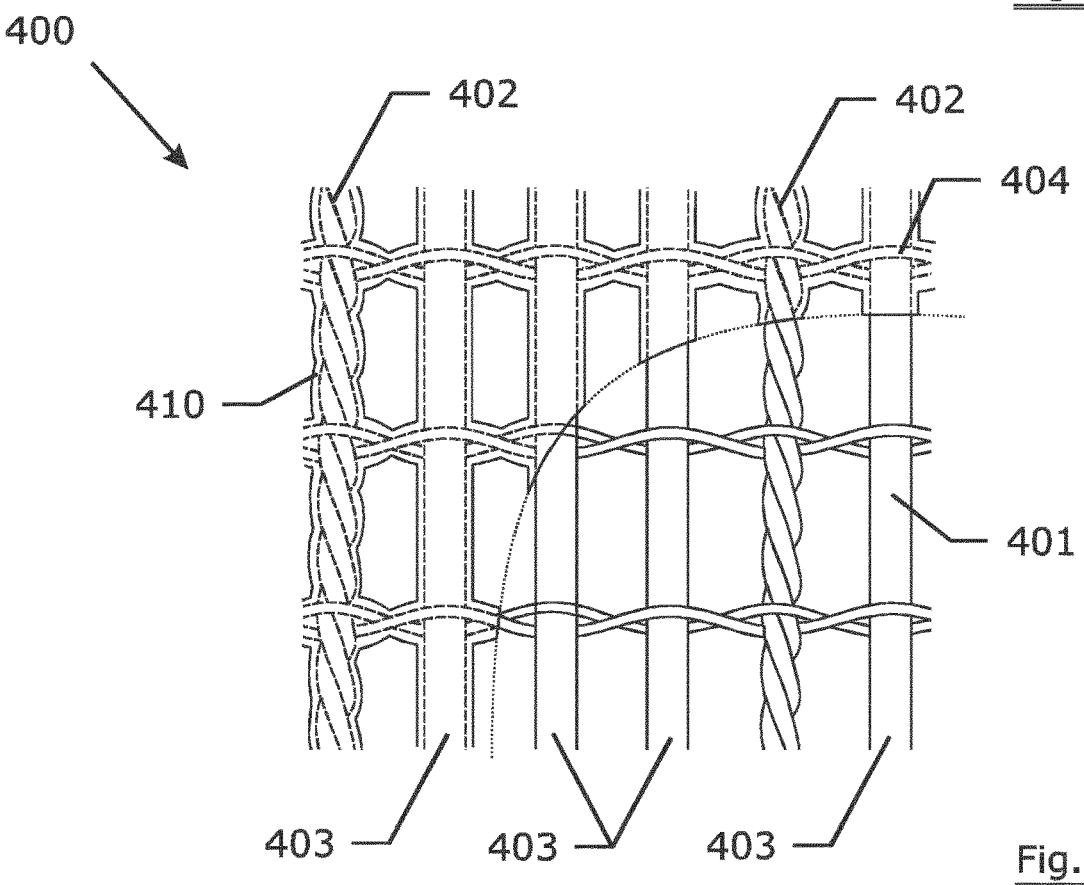
FIG. 4 is an illustration of a masonry reinforcement structure comprising a woven structure.

FIG. 4 is an illustration of a masonry reinforcement structure 400 comprising assemblies of grouped metal filaments 402 integrated in a woven structure 401. The woven structure 401 comprises in the warp direction a combination of polymer yarns 403 and assemblies of grouped metal filaments 402. The weft direction comprises a polymer yarn 404. A polymer coating 410, more particularly a styrene acrylic coating is applied on the woven structure 401.

Figure 5:
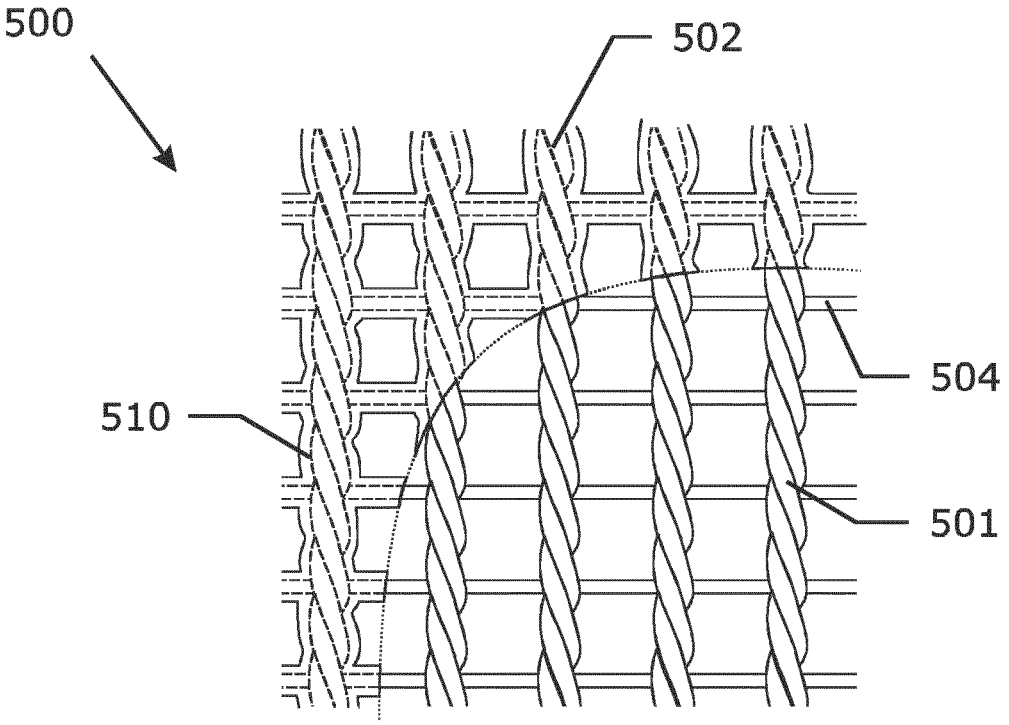
FIG. 5, FIG. 6 and FIG. 7 are illustrations of masonry reinforcements structures comprising parallel assemblies of grouped metal filaments and at least one connecting element.

FIG. 5 is an illustration of a masonry reinforcement structure 500 comprising a structure 501 of assemblies of grouped metal filaments 502 interconnected by a connecting structure 504. The connecting structure functions as positioning element, i.e. the connecting structure 504 positions the assemblies of grouped metal filaments 502. The connecting structure 504 comprises for example rovings. In preferred embodiments the masonry reinforcement structure 500 comprises a number of rovings positioned parallel or substantially parallel preferably in the transversal direction of the masonry reinforcement structure 500. The rovings may for example comprise glass rovings, polypropylene rovings or polyester roving.

The assemblies of grouped metal filaments 502 comprises for example steel cords or bundles of parallel or substantially parallel steel filaments. The assemblies of grouped metal filaments 502 can be connected to the connecting structure for example by means of gluing, stitching, knitting or embroidering.

A polymer coating 510 is applied on structure 501. The polymer coating 510 comprises for example styrene acrylic having a thickness of 10 μm, 15 μm or 20 μm.

Figure 6:
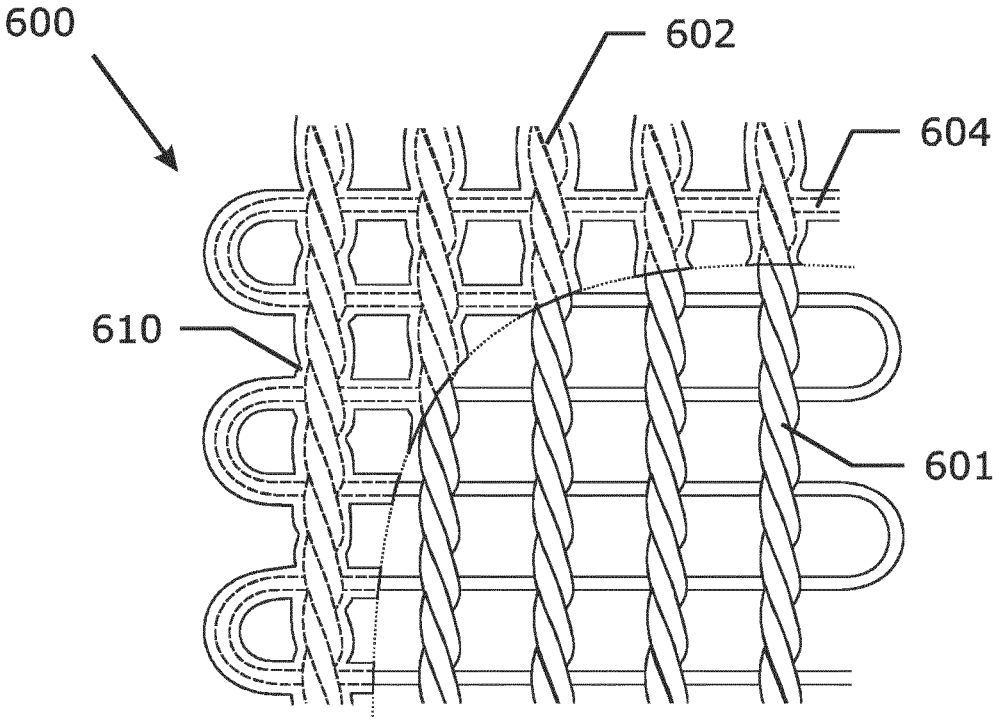

FIG. 6 is an illustration of a masonry reinforcement structure 600 comprising a structure 601 of assemblies of grouped metal filaments 602 interconnected by a connecting structure 604. The connecting structure 604 positions the assemblies of grouped metal filaments 602 and comprises for example one or a number of zig-zag like glass rovings.

The assemblies of grouped metal filaments 602 comprises for example steel cords or bundles of parallel or substantially parallel steel filaments. The assemblies of grouped metal filaments 602 can be connected to the connecting structure for example by means of gluing, stitching, knitting or embroidering.

A polymer coating 610 is applied on structure 601. The polymer coating 610 comprises for example styrene acrylic having a thickness of 10 μm, 15 μm or 20 μm.

Figure 7:
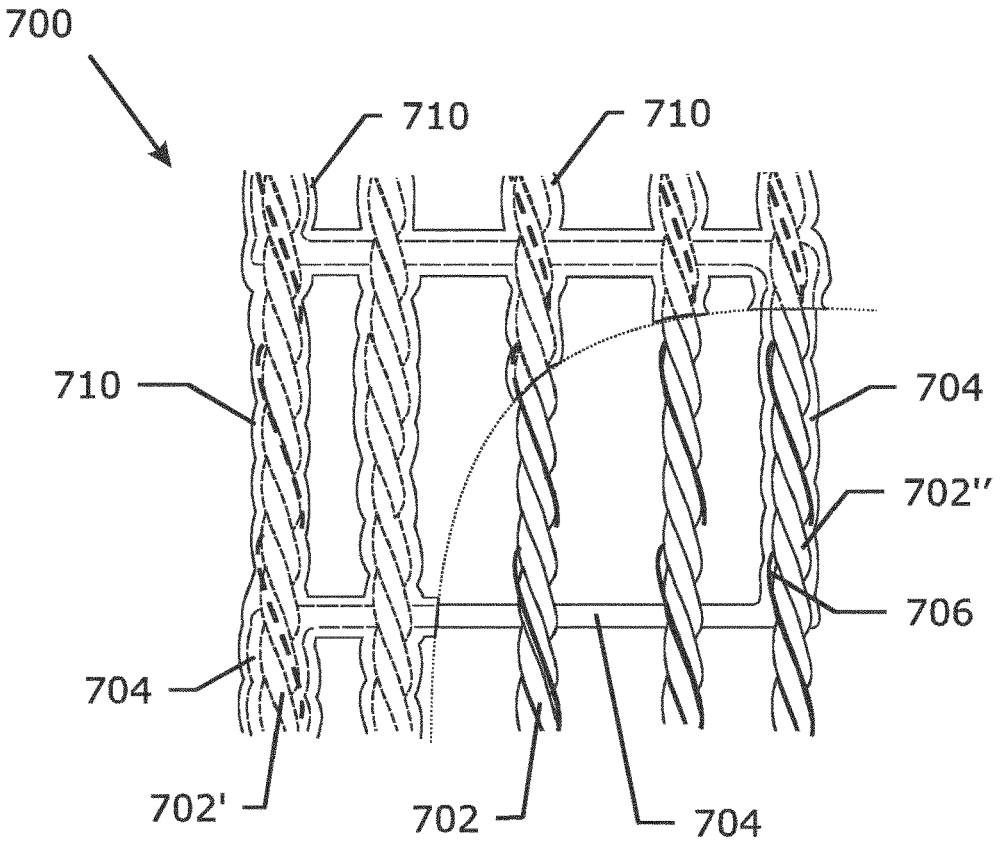

FIG. 7 is an illustration of a particular preferable and advantageous embodiment of a masonry reinforcement structure 700, which is similar to the one of FIG. 6.

The masonry reinforcement structure 700 comprises a number of parallel assemblies of steel filaments such as steel cords. These steel cords have a simple structure such as 1×3, 1×4, 2+2, 1+6. The density or concentration of the assemblies is greater at the left and right side than in the middle.

The positioning element that keeps the assemblies of steel filaments parallel comprises a glass roving 704. Starting from the left bottom of FIG. 7, this glass roving 704 runs parallel and in contact with the extreme left steel cord 702'. Going somewhat upwards, the glass roving 704 makes a bend and crosses all steel cords 702 until the glass roving 704 reaches the extreme right steel cord 702". From there on, the glass roving 704 runs parallel and in contact with the extreme right steel cord 702". At the right top of FIG. 7, the glass roving 704 makes again a bend and crosses all steel cords 702 until the glass roving 704 reaches the extreme left steel cord 702' where it restarts to run parallel and in contact with the extreme left steel cord 702'.

The positioning element also comprises textile yarns 706, preferably one per steel cord 702. These textile yarns 706 are wrapped around the steel cords 702', 702, 702" and around the glass roving 704, in case the glass roving is in contact with the particular steel cord 702, 702', 702". The glass roving 704 together with the textile yarns 706 form the positioning element to keep the steel cords 702', 702, 702" parallel to each other.

Once the operation of zigzagging of the glass roving 704 and of wrapping of the textile yarns 706 has been done, the thus formed fabric goes in a polymer bath and polymer 710 is adhering to the fabric, more particularly to the glass roving 704 and the textile yarns 706. The polymer 710 thus further secures the parallel relationship between the steel cords 702. This is particularly true in case the polymer can penetrate inside the textile yarns. In addition and next to a coating already present on the steel filaments or steel cords, the polymer adds to the corrosion protection of the steel cords.

Figure 8:
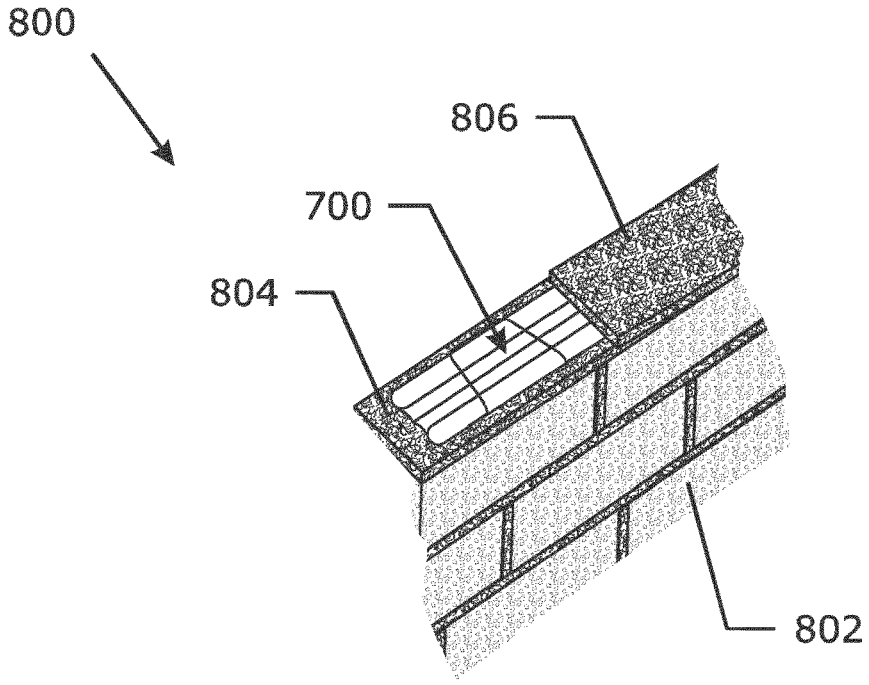
FIG. 8 illustrates the use of a masonry reinforcement structure in a masonry

FIG. 8 shows a masonry 800 made of bricks 802. During manufacture of the masonry 800, the top layer of bricks is covered with an bottom layer 804 of mortar or glue. The masonry reinforcement 700 is unrolled upon this bottom layer 804. Thereafter the masonry reinforcement 700 is covered with a top layer 806 of mortar or glue.

It is not strictly necessary to lay two layers (804, 806) of mortar or glue. One single layer, e.g. the bottom layer, may be sufficient.

The invention claimed is:

1. A masonry reinforcement structure having a length, said structure comprising at least two assemblies of grouped metal filaments, at least one positioning element for positioning said at least two assemblies of grouped metal filaments in a predetermined position, said positioning element comprising a zigzag roving or zigzag yarn that runs over the entire length of the structure in a zigzag way, crossing various times said assemblies, said positioning element further comprising textile yarns, said textile yarns being wrapped around said assemblies and also around said zigzag roving or zigzag yarn where said zigzag roving or zigzag yarn crosses said assemblies, said structure further comprising a polymer coating for securing said at least two assemblies of grouped metal filaments in said predetermined position, said polymer coating being applied on said at least two assemblies and on said at least one positioning element together, making a bond between said at least two assemblies and said at least one positioning element.

2. A masonry reinforcement structure according to claim 1, wherein said assemblies of grouped metal filaments comprise parallel or substantially parallel metal filaments.

3. A masonry reinforcement structure according to claim 2, said reinforcement comprising four or more assemblies.

4. A masonry reinforcement structure according to claim 3, said structure having longitudinal outer sides and longitudinal middle portions, two neighbouring assemblies spaced apart a distance, the distance between two neighbouring assemblies at the longitudinal outer sides being lower than the distance between two neighbouring assemblies in the longitudinal middle portion.

5. A masonry reinforcement structure according to claim 1, wherein said assemblies of grouped metal filaments comprise metal filaments that are twisted together.

6. A masonry reinforcement structure according to claim 1, wherein said polymer coating is selected from the group consisting of acrylic coatings, acrylic based coatings, polyethylene based coatings and polyurethane based coatings.

7. A masonry reinforcement structure according to claim 6, wherein said polymer coating has a thickness ranging between 1 and 100 μm.

8. A masonry reinforcement structure according to claim 6, wherein part of said polymer coating has penetrated into said textile yarn.

9. A masonry reinforcement structure according to claim 1, wherein said at least two assemblies of metal filaments in said predetermined position are oriented parallel or substantially parallel in the length direction of said masonry reinforcement structure.

10. A method to manufacture a masonry reinforcement structure as defined in claim 1, said method comprising the steps of providing at least two assemblies of grouped metal filaments;

providing at least one positioning element for positioning said at least two assemblies of grouped metal filaments in a predetermined position;

manufacturing a structure comprising said at least two assemblies of grouped metal filaments and said at least one positioning element;

applying a polymer coating on said structure comprising said at least two assemblies of grouped metal filaments and said at least one positioning element, making a bond between said at least two assemblies and said at least one positioning element.

11. A method to manufacture a masonry reinforcement structure according to claim 10, wherein said structure is manufactured by welding, weaving, gluing, stitching, knitting, braiding or embroidering or any combination thereof.

12. A roll of a masonry reinforcement structure as defined in claim 1, said masonry reinforcement structure being wound to form said roll.

13. A method to install a masonry reinforcement structure as defined in claim 1, said method comprising the steps of providing masonry comprising at least one layer of units or bricks;

uncoiling a masonry reinforcement structure as defined in claim 1;

installing said masonry reinforcement structure in a joint on the upper surface of the last layer of units or bricks;

providing the next layer of units or brick on said joint.

14. Masonry reinforced with at least one masonry reinforcement structure, said masonry comprising a number of layers of units or bricks and joints between two neighbouring layers of bricks, whereby at least one joint of said masonry is reinforced with a masonry reinforcement structure as defined in claim 1.

* * * * *